US006829847B2

(12) United States Patent
O'Shea et al.

(10) Patent No.: US 6,829,847 B2
(45) Date of Patent: Dec. 14, 2004

(54) PANT CUFF PROTECTOR

(75) Inventors: Sean O'Shea, Santa Barbara, CA (US); Fiona Jane Adams, Santa Barbara, CA (US)

(73) Assignee: Global Brand Marketing Inc., Santa Barbara, CA (US)

( * ) Notice: Subject to any disclaimer, the term of this patent is extended or adjusted under 35 U.S.C. 154(b) by 56 days.

(21) Appl. No.: 10/241,997

(22) Filed: Sep. 12, 2002

(65) Prior Publication Data

US 2004/0049948 A1 Mar. 18, 2004

(51) Int. Cl.[7] ..... A43C 15/00
(52) U.S. Cl. ..... 36/70 R; 36/1; 36/71.5
(58) Field of Search ..... 36/1, 70 R, 136, 36/71.5, 72 R

(56) References Cited

U.S. PATENT DOCUMENTS 257,036 A * 4/1882 McDermott ..... 36/70 R
383,500 A * 8/1888 Stewart ..... 36/56
586,666 A * 7/1897 Neuendorff ..... 36/70 R
5,740,557 A * 4/1998 Reid et al. ..... 2/209.13
6,295,743 B1 * 10/2001 Brooks ..... 36/105
6,532,687 B2 * 3/2003 Towns et al. ..... 36/11.5

FOREIGN PATENT DOCUMENTS

EP 1129634 * 9/2001

* cited by examiner

*Primary Examiner*—M. D. Patterson
(74) *Attorney, Agent, or Firm*—Jeffer, Mangels, Butler & Marmaro LLP

(57) ABSTRACT

A pant cuff protector for use with long pants for holding a cuff of a pant leg away from the ground comprises a first clamping body affixed proximate a wearer's ankle, a second clamping body magnetically attractable to the first clamping body, and optionally a strap therebetween.

12 Claims, 2 Drawing Sheets

PANT CUFF PROTECTOR

BACKGROUND OF THE INVENTION

1. Field of the Invention

The present invention relates to footwear, more particularly to a shoe worn with a full-length pant leg, and especially to a shoe having a pant cuff protector for holding down a cuff of a pant leg.

2. Description of the Related Art

For reasons of safety (when riding a bicycle or scooter), comfort (in the wind), fashion (to keep a slack properly draped when sitting or after rising from a seated position) and especially for keeping the pant cuff clean and dry (holding the cuff above the level of the shoe bottom), a person may wish to restrict the movement of a pant leg and more particularly a cuff portion of a trouser. A boy riding a bicycle might tie an elastic band around his pant leg or stuff his pant legs into his socks. However, these approaches might not meet an adult's preference for refinement.

It would be helpful if a rear portion of a pant cuff could conveniently be held away from the ground. It would also be helpful if the linking structure was simple, durable, reliable, inexpensive, and aesthetically pleasing or unobtrusive.

SUMMARY OF THE INVENTION

It is an object of the present invention to provide a pant cuff protector which is easily incorporated into a shoe, easily and conveniently closed about a cuff portion of a pant leg, structurally simple and inexpensive, durable, aesthetically pleasing and unobtrusive.

An exemplary embodiment of a pant cuff protector in accordance with the present invention comprises a at least one first clamping member securable about a person's foot and at least one second clamping member magnetically attractable to the first clamping member for holding a pant cuff.

In another exemplary embodiment, the first clamping member is attachable at a heel portion of a shoe.

In other exemplary embodiments, a pant cuff protector has a strap attachable at a heel or other portion of a shoe. The said second clamping member is located at the far end of the strap.

An exemplary embodiment of a pant cuff protecting shoe in accordance with the present invention comprises a shoe upper, at least one first clamping member securable to the shoe upper and at least one second clamping member magnetically attractable to the first for restraining a pant cuff.

In another exemplary embodiment of a pant cuff protecting shoe in accordance with the present invention, the first clamping member is located at a heel portion of the shoe upper and preferably an outer surface thereof.

In another exemplary embodiment, a spanning member, said spanning member is securable to the heel or other portion of the shoe upper. The spanning member includes the second clamping member and is long enough that its distal end can reach the first clamping member, allowing the two to interact.

In other exemplary embodiments, the spanning member comprises a fabric strap, preferably with the second clamping member attached to its upper surface.

An exemplary method of restraining a pant cuff above ground in accordance with the present invention comprising the steps of securing a first magnetic body on the person's shoe, draping a pant cuff about the shoe proximate the first magnetic body and magnetically clamping a second magnetic body onto the pant cuff over the first magnetic body.

Another exemplary method further includes the steps of securing one end of a length of material to the shoe and securing the second magnetic body on the second end. The length of material prevents loss of the second magnetic body and also helps to hold any excess length of pant cuff off the ground.

It is an advantage of the present invention that it prevents the rear portion of the pant cuff from draping to the level of the shoe bottom. Especially when the pant leg is cut long so as to break heavily over the shoes of the person wearing it, holding the cuff away from the ground prevents the pant cuff from being dragged through dirt and water and from being trod upon by the shoe heel. At the same time, it helps prevent the pant leg from rising when the knee is bent or when the wind blows and also helps keep the pant leg from interfering with such things as a chain and sprocket of a bicycle.

It is an additional advantage of the present invention that it does not require any rigid structure in order to exert clamping pressure to grasp the pant cuff. Thus, there is no rigid clamp arm structure which could be broken off by mechanical impact.

It is an additional advantage of the present invention that the surfaces that clamp the pant cuff to the shoe are smooth, non-lacerating, non-snagging, non-abrasive and unlikely to fracture.

It is an additional advantage of the present invention that, when engaged with or without a pant cuff therebetween, the clamping surfaces do not protrude greatly from the surface of the shoe. This reduces the likelihood that the clamp will be forcibly and unintentionally disengaged by mechanical force.

It is an additional advantage of the present invention that the surfaces that clamp the pant cuff are self-aligning, requiring no particular attention or care from the user.

It is an additional advantage of the present invention that the surfaces that clamp the pant cuff can be disengaged with a simple sweeping or hooking motion of a finger and can be re-closed without a pant cuff with a similar motion or by swinging the shoe until the clamping surfaces engage one another.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DESCRIPTION OF THE PREFERRED EMBODIMENTS

Figure 2:
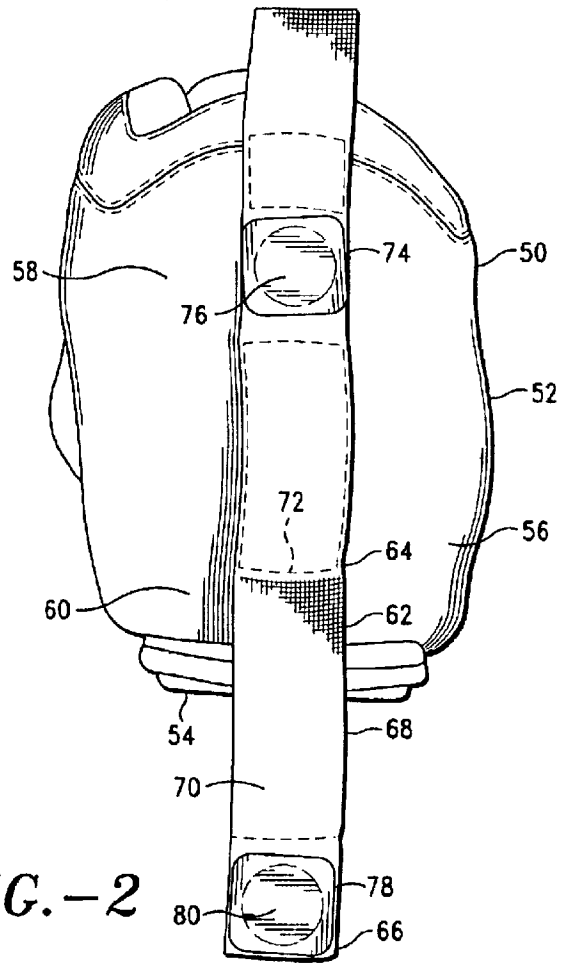
FIG. 2 is a rear view of a shoe incorporating a pant cuff protector in accordance with the present invention.
Figure 1:
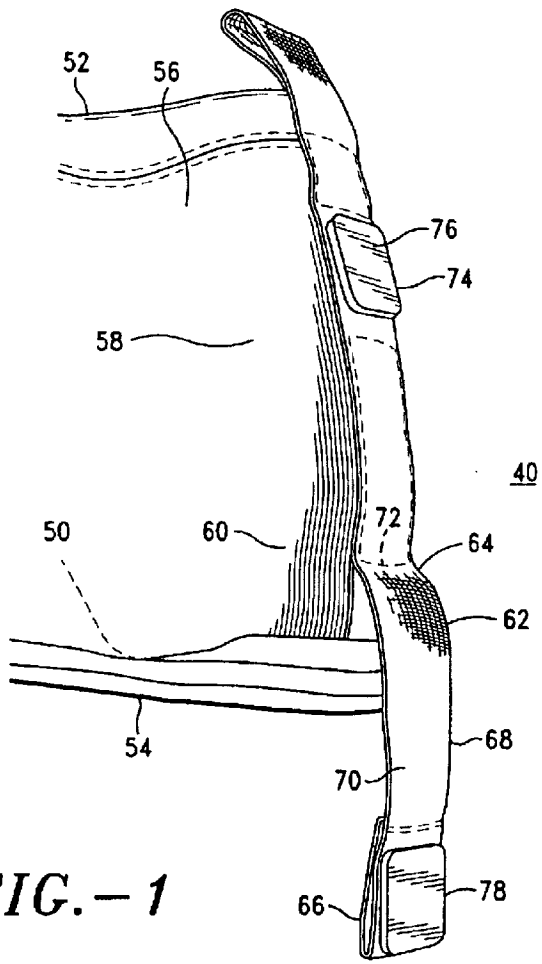
FIG. 1 is a rear perspective view of a shoe incorporating a pant cuff protector in accordance with the present invention.
Figure 4:
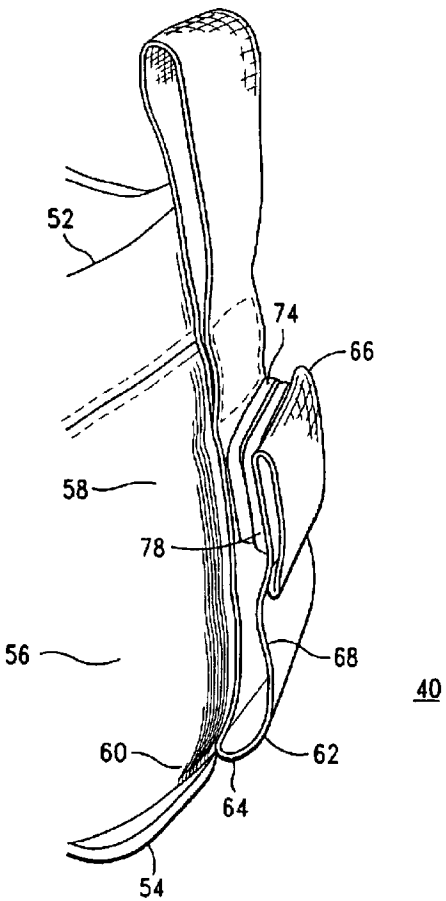
FIG. 4 is a perspective view of a shoe incorporating a pant cuff protector in accordance with the present invention without a pant cuff.
Figure 3:
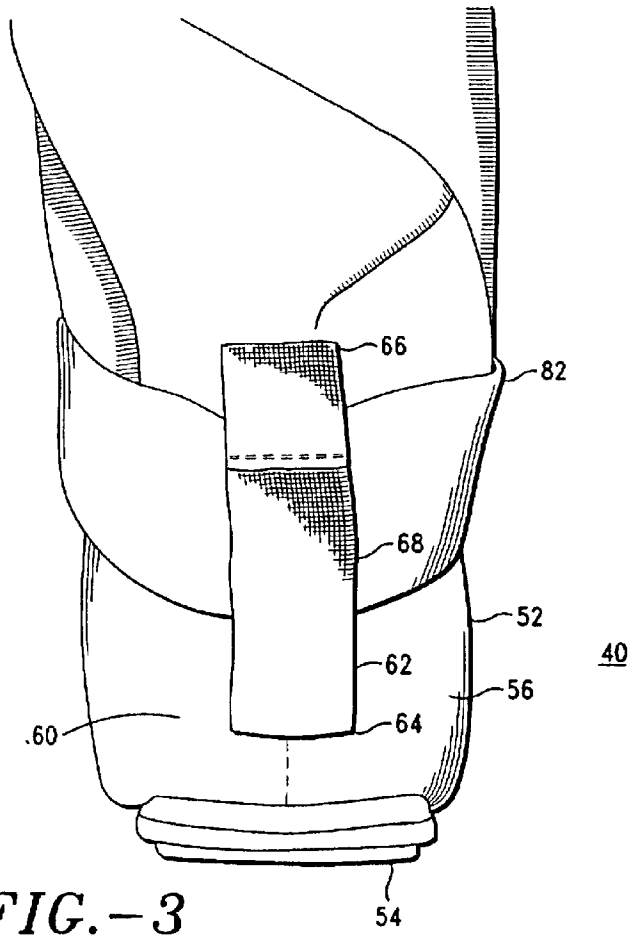
FIG. 3 is a rear view of a pant cuff protector in accordance with the present invention showing a pant cuff held therein.

The invention will now be described with reference to FIG. 1, which illustrates in side view a preferred embodiment of a shoe incorporating a pant cuff protector in accordance with the present invention shown generally by the reference number 40. A shoe 50 is shown including a leather shoe upper 52 and a synthetic shoe bottom 54. The shoe upper 52 comprises a heel 56 including a heel top, a heel lower portion 60 and a heel middle portion 58 about halfway therebetween.

A first magnetic body 74 has a thickness of approximately 2 millimeters, a height and width of approximately 18 millimeters and a smooth rearward-facing first clamping surface 76. The first clamping surface 76 is substantially flat and slightly beveled. The first magnetic body 74 is attached to the middle portion of the heel 56, such that it is centered approximately 70 millimeters above the shoe bottom 54.

A strong, thin fabric strap 62 has a width of approximately 18 millimeters, a strap proximal end, a strap distal end, a strap medial portion 68 extending therebetween, and a strap upper surface 70. Stitching 72 attaches the strap proximal portion to the heel lower portion 60 approximately 15 millimeters above the shoe bottom 54 and approximately 55 millimeters below where the first magnetic body 74 is centered. A second magnetic body 78, having the dimensions and shape of the first magnetic body 74, is attached to the strap upper surface 70 at the strap distal end 66 and is centered approximately 65 millimeters from the strap proximal end, such that the intervening strap medial portion 68 is approximately 53 millimeters in length. The second magnetic body 78 presents a second clamping surface 80 which faces the same direction as the strap upper surface 70.

The strap medial portion 68 is slightly longer than necessary to allow the strap distal end 66 and second magnetic body 78 to be positioned immediately to the rear of the first magnetic body 74, such that the second clamping surface 80 faces the first magnetic surface. The first magnetic body 74 and the second magnetic body 78 are mutually magnetically attracted. At least one of the first magnetic body 74 and the second magnetic body 78 comprises a permanent magnet. If one of them does not comprise a permanent magnet, then that one must comprise a body of a ferromagnetic material such as, for example, iron or mild steel. In this embodiment, both of them comprise permanent magnets.

A pant cuff 82 may be draped behind the heel 56. The strap distal portion may then be placed proximate the first magnetic body 74. The second magnetic body 78 will be attracted to the first magnetic body 74. The pant cuff 82 will be held between the second clamping surface 80 and the first clamping surface 76. The excess length of the strap medial portion 68 allows the second clamping surface 80 to be superimposed upon the first clamping surface 76 even though the strap 62 must reach around the material of the pant cuff 82. The strap medial portion helps restrain the lowermost portion of the pant cuff. Even if the pant cuff is long enough to drape to the ground behind the heel when clamped, the strap medial portion passes underneath the cuff and restrains it, thereby rendering it less critical that the pant cuff be clamped at exactly the correct level. This makes the present invention more convenient to use.

When it is desired to open the pant cuff protector, the strap medial portion 68 may be grasped and pulled rearward, downward or sideways, whereupon the strap distal portion will fall open. After the pant cuff 82 is removed, the strap distal end 66 may be swung upward, whereupon the second magnetic body 78 will be held in contact with the first magnetic body 74 and the strap medial portion 68 will be positioned proximate the heel 56.

While the foregoing detailed description has described several embodiments of a pant cuff protector in accordance with the present invention, it is to be understood that the above description is illustrative only and not limiting of the disclosed invention. For example, a strap proximal end may be attached to a different part of a shoe proximate the heel portion thereof, including, for example, the first clamping body or, as an alternative approach, the shoe heel bottom. The pant cuff protector in accordance with the present invention might be disposed on an upward-extending portion of a shoe bottom. It might also be disposed on a strap portion of a sandal, or be disposed on or tethered to a part of any footwear or lower-leg-wear, including an ankle bracelet, and may be magnetically closable about a person's ankle. One or more of the clamping bodies might be positionable on an inner surface of a shoe upper or boot upper or affixed so as to depend from a top of a heel counter either within or outside the shoe. One or more of the clamping bodies might be untethered or detachably tethered to the shoe or stowed within a compartment within or on the shoe. Indeed, it will be appreciated that the embodiments discussed above and the virtually infinite embodiments that are not mentioned could easily be within the scope and spirit of the present invention. Thus, the present invention is to be limited only by the claims as set forth below.

What is claimed is:

1. An apparatus, comprising:

a pant cuff;

at least one first clamping member; and at least one second clamping member, said second clamping member being magnetically attractable to said first clamping member;

wherein said first and second clamping members are positioned to hold said pant cuff between said clamping members.

2. A pant cuff protector as set forth in claim 1, wherein said first clamping member is attachable at a heel portion of a shoe.

3. A pant cuff protector as set forth in claim 2, further comprising a strap, said strap being attachable at a heel portion of a shoe, said second clamping member being located distally on said strap.

4. A pant cuff protector as set forth in claim 1, further comprising a strap, said strap being attachable at a portion of a shoe, said second clamping member being located distally on said strap.

5. A method of restraining a person's pant cuff above ground proximate a shoe the person is wearing, the method comprising the steps of:

securing a first magnetic body on the shoe;

draping a pant cuff about the shoe proximate said first magnetic body; and approximating a second magnetic body to said first magnetic body so as magnetically to clamp the pant cuff therebetween.

6. A method as set forth in claim 5, further comprising the steps of:

providing a length of a material having a first end and a second end and securing said first end to the shoe; and securing said second magnetic body on said second end, whereby said length of a material prevents loss of said second magnetic body and restrains the pant cuff.

7. A pant cuff protecting shoe comprising:

a shoe upper having a heel portion, a top portion and a bottom portion, wherein said top and bottom portions are spaced apart in a direction;

at least one first clamping member, said first clamping member being securable to said shoe upper and located at said heel portion;

at least one second clamping member, said second clamping member being magnetically attractable to said first clamping member for restraining at least a portion of a pant cuff, wherein said second clamping member is spaced apart from said first clamping member in said direction.

8. The pant cuff protecting shoe of claim 7, further comprising a strap, said strap being attachable at a portion of a shoe, said second clamping member being located distally on said strap.

9. The pant cuff protecting shoe of claim 8, wherein said portion of a shoe to which said strap is attachable is a heel portion.

10. The pant cuff protecting shoe of claim 7, wherein said first clamping member is affixed to an outer surface of said heel portion.

11. The pant cuff protecting shoe of claim 7, wherein said strap is attached to a lower portion of said heel portion, said strap has an upper surface, and said second clamping member is attached to said upper surface.

12. A shoe comprising:

a heel; and a strap having two magnetic positions separated by a folding position, a magnetic material being attached to the strap at each of the two magnetic positions, wherein the strap is connected to the heel;

wherein the heel has a top and bottom and an axis defined by the top and bottom, and wherein the strap is linear and disposed on the heel axis.

* * * * *